US009836012B2

(12) United States Patent
Shibuya

(10) Patent No.: US 9,836,012 B2
(45) Date of Patent: Dec. 5, 2017

(54) IMAGE FORMING APPARATUS

(71) Applicant: KYOCERA Document Solutions Inc., Osaka (JP)

(72) Inventor: Teppei Shibuya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/506,781

(22) PCT Filed: Oct. 5, 2015

(86) PCT No.: PCT/JP2015/078230
§ 371 (c)(1),
(2) Date: Feb. 27, 2017

(87) PCT Pub. No.: WO2016/067840
PCT Pub. Date: May 6, 2016

(65) Prior Publication Data

US 2017/0277111 A1 Sep. 28, 2017

(30) Foreign Application Priority Data

Oct. 31, 2014 (JP) ..... 2014-222827

(51) Int. Cl.
*G03G 15/00* (2006.01)
*G03G 15/16* (2006.01)

(52) U.S. Cl.
CPC ..... *G03G 15/80* (2013.01); *G03G 15/1605* (2013.01)

(58) Field of Classification Search
CPC ..... G03G 15/80; G03G 15/1605
USPC ..... 399/88
See application file for complete search history.

(56) References Cited

U.S. PATENT DOCUMENTS 8,290,385 B2 * 10/2012 Nakagawa ..... G03G 21/0047 399/88
9,207,623 B2 12/2015 Kamiyama
2008/0145084 A1 * 6/2008 Toizumi ..... G03G 15/08 399/66
2009/0003864 A1 * 1/2009 Yamaguchi ..... G03G 15/1615 399/66

(Continued)

FOREIGN PATENT DOCUMENTS

JP 2013-113901 A 6/2013

*Primary Examiner* — Susan Lee
(74) *Attorney, Agent, or Firm* — Studebaker & Brackett PC

(57) ABSTRACT

An image forming apparatus (1) includes image bearing members (31), transfer members (52), and a power supply section (57). The image bearing members (31) each bear one of toner images in different colors from one another. The transfer members (52) are located opposite to the image bearing members (31). The power supply section (57) charges the transfer members (52). Through the above, the toner images on the respective image bearing members (31) are transferred to a moving transfer target (51). The power supply section (57) includes a power supply device (58 or 58*a*) connected to at least two of the transfer members (52). The transfer members (52) connected to the power supply device (58 or 58*a*) are each located at a position shifted upstream or downstream of a corresponding one of the image bearing members (31) in a moving direction (X) of the transfer target (51).

14 Claims, 7 Drawing Sheets

(56) References Cited

U.S. PATENT DOCUMENTS

2013/0016169 A1* 1/2013 Ohtoshi ..... G03G 15/04045
399/301
2013/0136499 A1 5/2013 Kamiyama

* cited by examiner

IMAGE FORMING APPARATUS

TECHNICAL FIELD

The present invention relates to an image forming apparatus.

BACKGROUND ART

Color image forming apparatuses such as an electrophotographic color copier, a color printer, and a color multifunction peripheral are commonly known as image forming apparatuses. Further, color image forming apparatuses of an intermediate transfer belt type and a direct transfer belt type are commonly known as electrophotographic color image forming apparatuses.

The color image forming apparatuses of the intermediate transfer belt type and the direct transfer belt type include for example four photosensitive drums each bearing one of toner images in respective colors of yellow (Y), cyan (C), magenta (M), and black (Bk). The four photosensitive drums are arranged in tandem in a rotational direction (moving direction) of an endless belt. Therefore, the color image forming apparatuses of the intermediate transfer belt type and the direct transfer belt type are sometimes called tandem-type image forming apparatuses.

A tandem-type image forming apparatus gives a potential to each of photosensitive drums and causes the photosensitive drums to bear toner images in respective colors by electrostatic forces. In a color image forming apparatus of the intermediate transfer belt type, toner images in respective colors are transferred to an intermediate transfer belt as a transfer target, in order, such that the toner images are superimposed on one another. Through the above, a color toner image is formed on the intermediate transfer belt. The color toner image is then transferred from the intermediate transfer belt to a recording medium such as paper. In a color image forming apparatus of the direct transfer belt type, toner images in respective colors are transferred from respective photosensitive drums to a recording medium (transfer target) conveyed by a belt, in order, such that the toner images are superimposed on one another.

The tandem-type image forming apparatus gives a potential to each transfer roller (transfer member) located opposite to a corresponding one of the photosensitive drums when transferring the toner images in the respective colors from the respective photosensitive drums to the transfer target. The toner images in the respective colors are transferred from the respective photosensitive drums to the transfer target by a potential difference (transfer field) between each photosensitive drum and a corresponding one of the transfer rollers. Further, in the tandem-type image forming apparatus, static electricity is eliminated from the respective photosensitive drums after transfer of the toner images in the respective colors to the transfer target by for example irradiating the photosensitive drums with static elimination light.

By the way, in order to improve environment of an office or the like, a charging method that generates a reduced amount of ozone, such as a positive DC charging roller method, has been often employed in recent years as a method for charging photosensitive drums in an electrophotographic image forming apparatus. Through use of positively chargeable photosensitive members and employment of the positive DC charging roller method in a tandem-type image forming apparatus, an amount of generation of ozone can be reduced while securing fine-pixel transfer performance.

However, a DC charging roller method such as the positive DC charging roller method is inferior to a scorotron method in its ability to charge a photosensitive member. Therefore, a charge given to the surface of the photosensitive member by a transfer field cannot be completely canceled in a subsequent charging step and tends to remain on the surface of the photosensitive member. That is, the surface of the photosensitive member cannot be uniformly charged, and a potential difference derived from a previously transferred toner image (image) tends to be generated. In other words, history of the previously transferred toner image (image) tends to remain on the photosensitive member. Therefore, the DC charging roller method tends to cause a phenomenon so called transfer memory (drum ghost) in which the previously transferred toner image (image) is transferred lightly to the transfer target in a subsequent transfer step. As a method for solving the above problem, a method of irradiating a photosensitive drum before transfer of a toner image, i.e., a photosensitive drum bearing a toner image, with static elimination light is known (see for example Patent Literature 1).

An image forming apparatus described in Patent Literature 1 irradiates respective photosensitive drums located upstream and downstream in a moving direction of a belt (moving direction of a transfer target) with static elimination light using a static eliminating substrate located between adjacent photosensitive drums. Through the above, the downstream photosensitive drum is irradiated with the static elimination light after transfer of a toner image and the upstream photosensitive drum is irradiated with the static elimination light before transfer of a toner image. In the following description, static elimination after transfer of a toner image may be referred to as post-transfer static elimination and static elimination before transfer of a toner image may be referred to as pre-transfer static elimination.

The pre-transfer static elimination reduces a potential difference between an imaged portion (portion bearing a toner image) and a non-imaged portion (portion bearing no toner image) on the surface of the photosensitive drum. However, in a configuration in which the pre-transfer static elimination and the post-transfer static elimination are performed using a single static eliminating substrate, the pre-transfer static elimination cannot be performed on the most upstream photosensitive drum in the moving direction of the belt. As a result, at the time of transfer of toner images in respective colors from the respective photosensitive drums to a transfer target, a surface potential of the most upstream photosensitive drum may be higher than surface potentials of the other photosensitive drums. In the above situation, if a potential is given to each transfer roller from a single power source at the time of transfer of the toner images in the respective colors from the respective photosensitive drums to the transfer target, a value of a current flowing into the most upstream photosensitive drum becomes excessively large and values of currents flowing into the other photosensitive drums decrease. Therefore, the transfer memory may occur and density may be insufficient. That is, image quality may be deteriorated.

Therefore, a high-voltage power source is typically provided for each transfer roller (transfer member) to maintain currents flowing into the respective photosensitive drums constant.

CITATION LIST

Patent Literature

[Patent Literature 1]

Japanese Patent Application Laid-Open Publication No. 2013-113901

SUMMARY OF INVENTION

Technical Problem

However, simplification and downsizing of an image forming apparatus are hindered in a configuration in which a high-voltage power source is provided for each transfer member. Therefore, there is a demand for development of an image forming apparatus that realizes reduction of a required number of power sources without deterioration of image quality.

In view of the above problem, the present invention aims at providing an image forming apparatus that realizes reduction of a required number of power sources while preventing deterioration of image quality.

Solution to Problem

An image forming apparatus according to the present invention is capable of forming a color image by transferring toner images in respective colors different from one another such that the toner images are superimposed on one another. The image forming apparatus includes a plurality of image bearing members, a plurality of transfer members, and a power supply section. The plurality of image bearing members are each capable of bearing one of the toner images in the respective colors. The plurality of transfer members are each located opposite to a corresponding one of the plurality of image bearing members. The power supply section is capable of causing the toner images on the respective image bearing members to be transferred to a moving transfer target by charging the plurality of transfer members. The power supply section includes a first power supply device connected to at least two transfer members of the plurality of transfer members. The at least two transfer members of the plurality of transfer members connected to the first power supply device are each located at a position shifted upstream or downstream of a corresponding one of the image bearing members in a moving direction of the moving transfer target.

Advantageous Effects of Invention

According to the present invention, a required number of power sources can be reduced while preventing deterioration of image quality.

DESCRIPTION OF EMBODIMENTS

Figure 1:
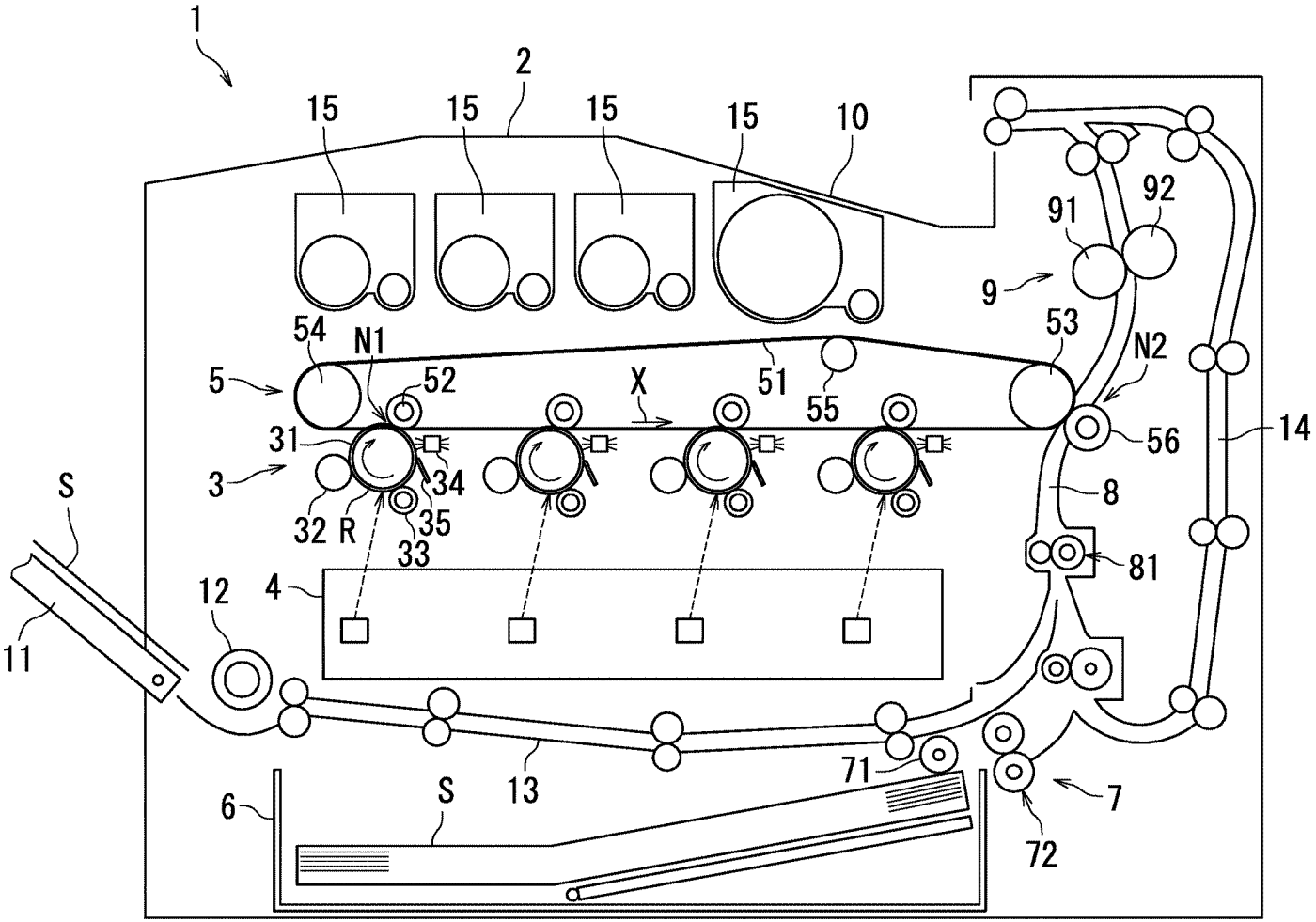
FIG. 1 is a vertical cross sectional view of an image forming apparatus according to an embodiment of the present invention.

The following describes an embodiment of the present invention with reference to the drawings. Note that in the drawings, elements that are the same or substantially equivalent are labelled using the same reference signs and explanation thereof is not repeated. The drawings schematically illustrate elements of configuration in order to facilitate understanding. Numerical values, materials of the elements of configuration and the like described in the following embodiment are merely examples that do not impart any specific limitations and may be altered in various ways so long as such alterations do not substantially deviate from effects of the present invention.

FIG. 1 is a vertical cross sectional view of an image forming apparatus according to the present embodiment. The image forming apparatus 1 of the present embodiment is a color image forming apparatus of an intermediate transfer belt type. The image forming apparatus 1 is capable of forming a color image (color toner image) by transferring toner images in respective colors of yellow (Y), cyan (C), magenta (M), and black (Bk) such that the toner images are superimposed on one another.

The image forming apparatus 1 includes a housing 2, an image forming section 3, an exposure device 4, a transfer section 5, a paper feed cassette 6, a paper feed section 7, a first sheet conveyance section 8, a fixing section 9, an exit tray 10, a manual feed tray 11, a paper feed roller 12, a second sheet conveyance section 13, a third sheet conveyance section 14, and toner supplying sections 15.

The image forming section 3 includes four photosensitive drums 31 (image bearing members) corresponding to the respective colors of yellow, cyan, magenta, and black. The photosensitive drums 31 are each capable of bearing one of toner images in the respective colors different from one another. The photosensitive drums 31 each have a diameter $\phi$ of for example 30 mm The image forming section 3 is capable of forming the toner images in the respective colors of yellow, cyan, magenta, and black each on the circumferential surface of one of the four photosensitive drums.

Specifically, the image forming section 3 includes four development rollers 32 corresponding to the respective colors of yellow, cyan, magenta, and black. The development rollers 32 are each located opposite to a corresponding one of the photosensitive drums 31. The development rollers 32 supply toners of the respective colors to the respective photosensitive drums 31. Through the above, the photosensitive drums 31 bear the toner images in the respective colors.

The exposure device 4 is located below the four photosensitive drums 31. The exposure device 4 scans each photosensitive drum 31 corresponding to a color necessary to form an image with light (for example, laser beam) based on image data. As a result, an electrostatic latent image is formed on the photosensitive drum 31 scanned with the light. Thereafter, a toner (developer) is supplied from a corresponding one of the development rollers 32 to the photosensitive drum 31 on which the electrostatic latent image has been formed. Through the above, the electrostatic latent image is developed to form a toner image in the color necessary to form the image.

The transfer section 5 includes an endless intermediate transfer belt 51 (transfer target) and four primary transfer rollers 52 (transfer members) each located opposite to a corresponding one of the four photosensitive drums 31.

The intermediate transfer belt 51 includes a base layer formed from a resin and a coating layer covering a surface of the base layer. The thickness of the intermediate transfer belt 51 is about 80-120 μm and the thickness of the coating layer is about 10 μm. A thermoplastic resin is for example employable as a material of the base layer. Examples of employable thermoplastic resins include polyamide (PA) and polycarbonate (PC). Note that a thermosetting resin may be used as a material of the base layer of the intermediate transfer belt 51. Examples of employable thermosetting resins include polyimide (PI), polyamide alloy (PAA), and silicone resins. An insulating resin is used as a material of the coating layer. Examples of employable insulating resins include polycarbonate, acrylic resins, and fluorine-based resins.

The base layer of the intermediate transfer belt 51 contains electrically conductive particles such as carbon black and ionic conductive materials. The volume resistivity of the base layer is controlled to be from about $1.0\times10^{8}$ Ω·cm to about $1.0\times10^{11}$ Ω·cm at the time of application of a voltage of 250 V. The surface resistivity of the intermediate transfer belt 51 is controlled to be at least $1.0\times10^{10}$ Ω/sq at the time of application of a voltage of 250 V. The surface resistivity of the intermediate transfer belt 51 may be for example at least $1.0\times10^{10}$ Ω/sq and no greater than $1.0\times10^{11}$ Ω/sq at the time of application of a voltage of 250 V.

The primary transfer rollers 52 are elastic rollers each including a metal shaft such as an iron shaft and an elastic layer surrounding the metal shaft. The primary transfer rollers 52 each have a diameter ϕ of for example 12.0 mm The thickness of the elastic layer is for example about 3 mm. An electrically conductive foamed elastic body containing electrically conductive particles such as carbon black and ionic conductive materials is for example employable as a material of the elastic layer. Examples of employable electrically conductive foamed elastic bodies include foamed EPDM obtained by foaming an ethylene-propylenediene rubber and foamed NBR obtained by foaming a nitrile rubber. The surface resistivity of each of the primary transfer rollers 52 is controlled to be at least $1.0\times10^{6}$ Ω/sq at the time of application of a voltage of 1000 V. The surface resistivity of each of the primary transfer rollers 52 may for example be at least $1.0\times10^{6.8}$ Ω/sq and no greater than $1.0\times10^{7.8}$ Ω/sq at the time of application of a voltage of 1000 V.

The intermediate transfer belt 51 is located above the four photosensitive drums 31. The primary transfer rollers 52 are each located inside of the intermediate transfer belt 51. The primary transfer rollers 52 are each located opposite to a corresponding one of the photosensitive drums 31 with the intermediate transfer belt 51 therebetween. The primary transfer rollers 52 are each pressed against the circumferential surface of a corresponding one of the photosensitive drums 31 with the intermediate transfer belt 51 therebetween. As a result, each of the primary transfer rollers 52 and a corresponding one of the photosensitive drums 31 form a primary transfer nip N1 therebetween.

The transfer section 5 further includes a drive roller 53, a driven roller 54, and a tension roller 55. The intermediate transfer belt 51 is stretched around the drive roller 53, the driven roller 54, and the tension roller 55. The tension roller 55 urges the intermediate transfer belt 51 outward from the inside of the intermediate transfer belt 51. The tension roller 55 gives a specific tension to the intermediate transfer belt 51. The intermediate transfer belt 51 rotates in a rotational direction X (counterclockwise direction in FIG. 1) in accompaniment to rotation of the drive roller 53.

The toner images formed (carried) on the circumferential surfaces of the respective photosensitive drums 31 are each transferred (primarily transferred) to the outer circumferential surface of the intermediate transfer belt 51 rotating in the rotational direction X at a corresponding one of the primary transfer nips N1. For example, in a situation in which toner images in a plurality of colors are necessary to form an image, the toner images are each formed on the circumferential surface of one of at least two photosensitive drums 31 of the four photosensitive drums 31. The toner images are transferred to the outer circumferential surface of the intermediate transfer belt 51 in order from upstream in the rotational direction X of the intermediate transfer belt 51 (the moving direction of the transfer target) along with rotation of the intermediate transfer belt 51 such that the toner images are superimposed on one another.

The transfer section 5 further includes a secondary transfer roller 56 located opposite to the drive roller 53. The secondary transfer roller 56 is pressed against the circumferential surface of the drive roller 53 with the intermediate transfer belt 51 therebetween. As a result, the secondary transfer roller 56 and the drive roller 53 form a secondary transfer nip N2 therebetween.

The paper feed cassette 6 is located below the exposure device 4. The paper feed cassette 6 is capable of accommodating a plurality of sheets S (recording medium). The sheets S are for example paper.

The paper feed section 7 picks up one of the sheets S accommodated in the paper feed cassette 6 and feeds the sheet S to the most upstream part of the first sheet conveyance section 8. Specifically, the paper feed section 7 includes a pickup roller 71 and a paper feed roller pair 72. The pickup roller 71 is located above an end of the paper feed cassette 6. The pickup roller 71 picks up the sheet S from the paper feed cassette 6. The paper feed roller pair 72 feeds the sheet S to the most upstream part of the first sheet conveyance section 8. The paper feed roller pair 72 feeds one sheet S at a time to the first sheet conveyance section 8.

The first sheet conveyance section 8 conveys the sheet S to the secondary transfer nip N2. Through the above, toner images are transferred to the sheet S at the secondary transfer nip N2. Specifically, the first sheet conveyance section 8 includes a registration roller pair 81 located upstream of the secondary transfer nip N2. The registration roller pair 81 controls a timing at which the sheet S passes through the secondary transfer nip N2.

The first sheet conveyance section 8 conveys the sheet S to which the toner images have been transferred to the exit tray 10 via the fixing section 9. The exit tray 10 is provided on the top face of the housing 2.

The fixing section 9 includes a pressure member 91 and a heating member 92. The pressure member 91 and the heating member 92 apply pressure and heat to the sheet S, whereby the unfixed toner images are fixed to the sheet S.

The manual feed tray 11 is attached to a side wall of the housing 2. A plurality of sheets S can be placed on the manual feed tray 11. The paper feed roller 12 is located on the base end side of the manual feed tray 11. The paper feed roller 12 feeds a sheet S on the manual feed tray 11 to the most upstream part of the second sheet conveyance section 13. The second sheet conveyance section 13 joins the first sheet conveyance section 8 at a position upstream of the registration roller pair 81. The second sheet conveyance section 13 conveys the sheet S to the first sheet conveyance section 8.

The upstream end of the third sheet conveyance section 14 is connected to the first sheet conveyance section 8 at a position downstream of the fixing section 9, and the downstream end of the third sheet conveyance section 14 is connected to the first sheet conveyance section 8 at a position upstream of the registration roller pair 81. The third sheet conveyance section 14 conveys a sheet S to a position of the first sheet conveyance section 8 upstream of the registration roller pair 81 after toner images are fixed to a surface of the sheet S by the fixing section 9 during duplex printing. The third sheet conveyance section 14 conveys the sheet S such that the sheet S is reversed to transfer toner images to the other surface of the sheet S.

The four toner supplying sections 15 corresponding to the respective colors of yellow, cyan, magenta, and black are located above the intermediate transfer belt 51. The toner supplying sections 15 each contain a toner of one of the respective colors and supply the toners to the image forming section 3.

Figure 2:
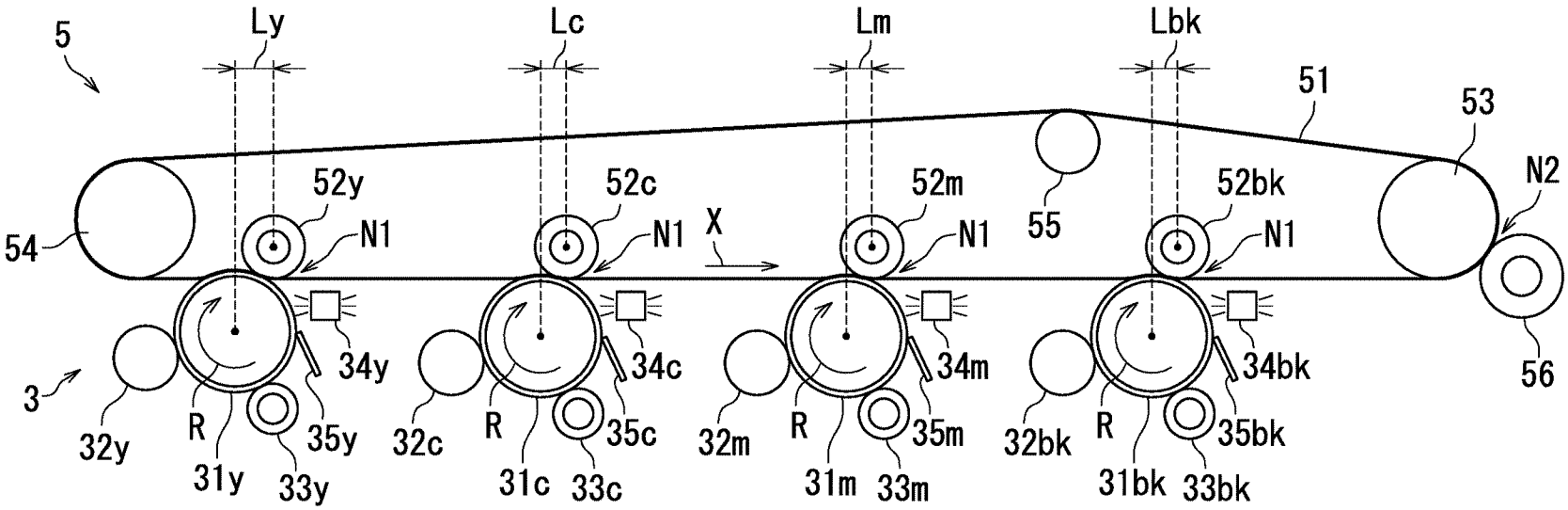
FIG. 2 is an enlarged vertical cross sectional view of an image forming section and a transfer section according to the embodiment of the present invention.
Figure 3:
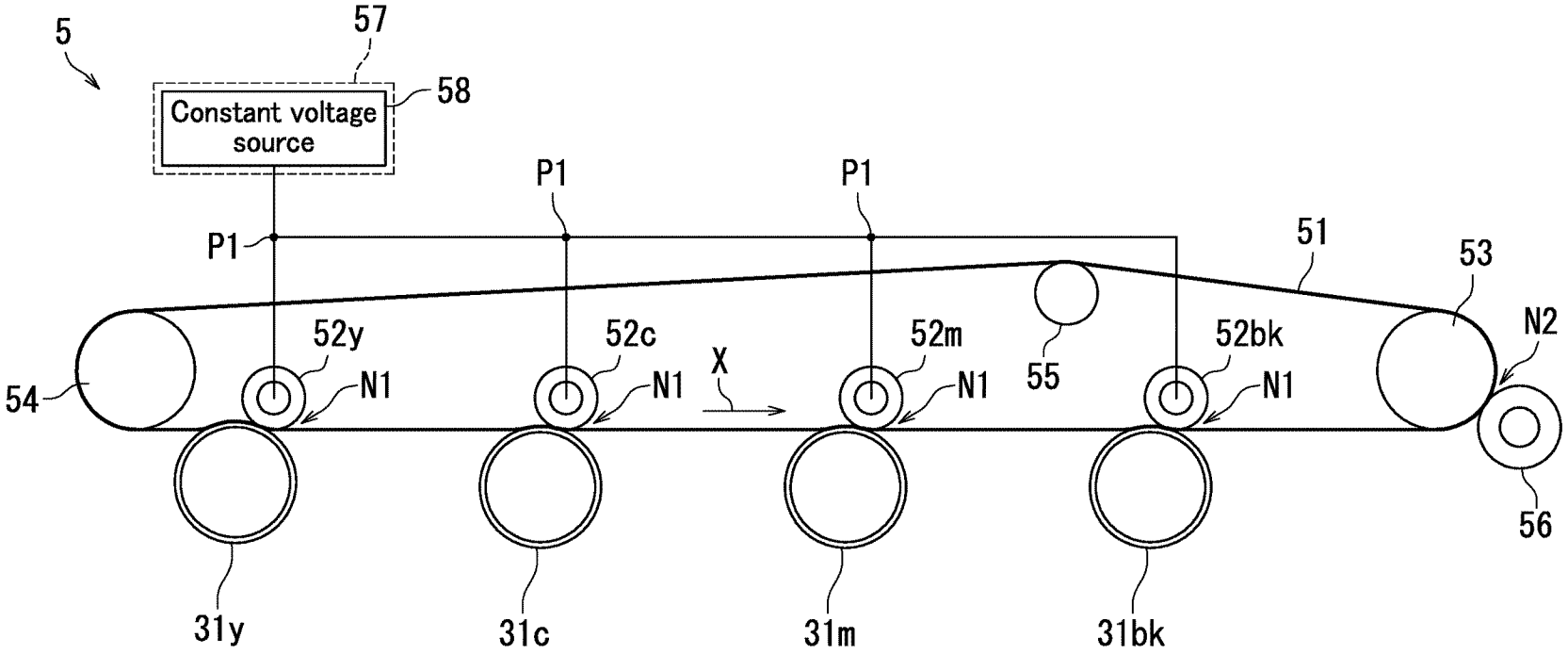
FIG. 3 is a diagram illustrating a power supply system for primary transfer rollers according to the embodiment of the present invention.

The following describes the image forming section 3 and the transfer section 5 in detail with reference to FIGS. 2 and 3. In FIGS. 2 and 3, letters "y", "c", "m", and "bk" are appended to reference numerals of elements such as the photosensitive drums 31 corresponding to the yellow (Y), cyan (C), magenta (M), and black (Bk) colors, respectively.

FIG. 2 is an enlarged vertical cross sectional view of the image forming section 3 and the transfer section 5. As illustrated in FIG. 2, the image forming section 3 includes charging rollers 33*y*, 33*c*, 33*m*, 33*bk* (chargers), static eliminating devices 34*y*, 34*c*, 34*m*, 34*bk* (static eliminating sections), and cleaning blades 35*y*, 35*c*, 35*m*, 35*bk* (cleaning sections) in addition to the photosensitive drums 31*y*, 31*c*, 31*m*, 31*bk* (image bearing members), and the development rollers 32*y*, 32*c*, 32*m*, 32*bk* (development sections). The charging rollers 33*y*, 33*c*, 33*m*, and 33*bk* are each located opposite to the circumferential surface of a corresponding one of the photosensitive drums 31*y*, 31*c*, 31*m*, and 31*bk*. The static eliminating devices 34*y*, 34*c*, 34*m*, and 34*bk* are each located opposite to the circumferential surface of a corresponding one of the photosensitive drums 31*y*, 31*c*, 31*m*, and 31*bk*. The cleaning blades 35*y*, 35*c*, 35*m*, and 35*bk* are each located opposite to the circumferential surface of a corresponding one of the photosensitive drums 31*y*, 31*c*, 31*m*, and 31*bk*. The photosensitive drums 31*y*, 31*c*, 31*m*, and 31*bk* each have a photosensitive layer and rotate in a rotation direction R (clockwise direction in FIG. 2). The charging roller 33*y*, the development roller 32*y*, the static eliminating device 34*y*, and the cleaning blade 35 are arranged in the noted order in the rotation direction R of the corresponding photosensitive drum 31*y*. Likewise, the charging rollers 33*c*, 33*m*, 33*bk*, the development rollers 32*c*, 32*m*, 32*bk*, the static eliminating devices 34*c*, 34*m*, 34*bk* and the cleaning blades 35*c*, 35*m*, 35*bk* are each arranged in the rotation direction R of a corresponding one of the photosensitive drums 31*c*, 31*m*, 31*bk* in the noted order.

The charging rollers 33*y*, 33*c*, 33*m*, and 33*bk* each charge a corresponding one of the photosensitive drums 31*y*, 31*c*, 31*m*, and 31*bk*. The charging rollers 33*y*, 33*c*, 33*m*, and 33*bk* in the present embodiment are positive DC charging rollers. That is, the charging rollers 33*y*, 33*c*, 33*m*, and 33*bk* each apply a positive direct current voltage to a corresponding one of the photosensitive drums 31*y*, 31*c*, 31*m*, and 31*bk*. Through the above, the surfaces of the photosensitive drums 31*y*, 31*c*, 31*m*, and 31*bk* (surfaces of the photosensitive layers) are each charged to a positive potential. The surface potentials of the photosensitive drums 31*y*, 31*c*, 31*m*, and 31*bk* can be for example from about 350 V to about 600 V.

The static eliminating devices 34*y*, 34*c*, 34*m*, and 34*bk* are each located downstream of a corresponding one of the primary transfer nips N1 in the rotation direction R of the photosensitive drums 31*y*, 31*c*, 31*m*, and 31*bk*. The static eliminating devices 34*y*, 34*c*, 34*m*, and 34*bk* irradiate the circumferential surfaces of the photosensitive drums 31*y*, 31*c*, 31*m*, and 31*bk* with static elimination light. That is, the static eliminating device 34*y* irradiates with the static elimination light, the circumferential surface of the photosensitive drum 31*y* located upstream of the static eliminating device 34*y* in the rotational direction X of the intermediate transfer belt 51. Likewise, the static eliminating devices 34*c*, 34*m*, and 34*bk* irradiate with the static elimination light, the circumferential surfaces of the photosensitive drums 31*c*, 31*m*, and 31*bk* respectively, which are located upstream of the static eliminating devices 34*c*, 34*m*, and 34*bk* respectively in the rotational direction X of the intermediate transfer belt 51. Through the above, post-transfer static elimination is performed on the photosensitive drums 31*y*, 31*c*, 31*m*, and 31*bk*. That is, static electricity is eliminated (charges are removed) from the circumferential surfaces of the photosensitive drums 31*y*, 31*c*, 31*m*, and 31*bk* after the primary transfer.

The static eliminating device 34*y* is located between the adjacent photosensitive drums 31*y* and 31*c*. The static eliminating device 34*c* is located between the adjacent photosensitive drums 31*c* and 31*m*. The static eliminating device 34*m* is located between the adjacent photosensitive drums 31*m* and 31*bk*. The static eliminating device 34*bk* is located downstream of the photosensitive drum 31*bk* in the rotational direction X of the intermediate transfer belt 51. That is, the static eliminating device 34*bk* is located the most downstream among the static eliminating devices 34*y*, 34*c*, 34*m*, and 34*bk* in the rotational direction X of the intermediate transfer belt 51. The static eliminating device 34*y* located upstream of the static eliminating device 34*bk* is capable of further irradiating with light, the photosensitive drum 31*c* located downstream of the static eliminating device 34*y* in the rotational direction X of the intermediate transfer belt 51. Likewise, the static eliminating devices 34*c* and 34*m* located upstream of the static eliminating device 34*bk* is capable of further irradiating with light, the photosensitive drums 31*m* and 31*bk* respectively, which are located downstream of the static eliminating devices 34*c* and 34*m* respectively in the rotational direction X of the intermediate transfer belt 51. Through the above, pre-transfer static elimination is performed on the photosensitive drums 31*c*, 31*m*, and 31*bk*. That is, static electricity is eliminated from the circumferential surfaces of the photosensitive drums 31*c*, 31*m*, and 31*bk* before the primary transfer (the photosensitive drums 31*c*, 31*m*, and 31*bk* bearing the toner images). The pre-transfer static elimination reduces a potential difference between an imaged portion (portion bearing a toner image) and a non-imaged portion (portion bearing no toner image) on the circumferential surface of each of the photosensitive drums 31*c*, 31*m*, and 31*bk*. Through the above, occurrence of the transfer memory is prevented.

Edges of the cleaning blades 35*y*, 35*c*, 35*m*, and 35*bk* are each in contact with the circumferential surface of a corresponding one of the photosensitive drums 31*y*, 31*c*, 31*m*, and 31*bk*. Through the above, toners remaining on the circumferential surfaces of the photosensitive drums 31*y*, 31*c*, 31*m*, and 31*bk* after the primary transfer can be removed. Specifically, the cleaning blades 35*y*, 35*c*, 35*m*, and 35*bk* scrape the residual toners.

The primary transfer rollers 52*y*, 52*c*, 52*m*, and 52*bk* are each displaced (shifted) downstream of a position right above a corresponding one of the photosensitive drums 31*y*, 31*c*, 31*m*, and 31*bk* in the rotational direction X (moving direction) of the intermediate transfer belt 51. Specifically, the central axis of each of the primary transfer rollers 52*y*, 52*c*, 52*m*, and 52*bk* is displaced downstream of the central axis of a corresponding one of the photosensitive drums 31*y*, 31*c*, 31*m*, and 31*bk* in the rotational direction X of the intermediate transfer belt 51.

FIG. 3 is a diagram illustrating a power supply system for the four primary transfer rollers 52*y*, 52*c*, 52*m*, and 52*bk*. As illustrated in FIG. 3, the transfer section 5 further includes a power supply section 57 connected to the four primary transfer rollers 52*y*, 52*c*, 52*m*, and 52*bk*. The power supply section 57 is capable of charging each of the primary transfer rollers 52*y*, 52*c*, 52*m*, and 52*bk*. The power supply section 57 in the present embodiment includes a constant voltage source 58 (first power supply device) connected to the four primary transfer rollers 52*y*, 52*c*, 52*m*, and 52*bk*. The constant voltage source 58 applies a bias voltage (transfer voltage) to each of the primary transfer rollers 52*y*, 52*c*, 52*m*, and 52*bk* at the time of the primary transfer. As a result, the primary transfer rollers 52*y*, 52*c*, 52*m*, and 52*bk* are charged. A potential difference (transfer field) between a surface potential of each of the photosensitive drums 31*y*, 31*c*, 31*m*, and 31*bk* and a surface potential of a corresponding one of the primary transfer rollers 52*y*, 52*c*, 52*m*, and 52*bk* causes the primary transfer of the toner images from the circumferential surfaces of the respective photosensitive drums 31*y*, 31*c*, 31*m*, and 31*bk* to the outer circumferential surface of the rotating intermediate transfer belt 51 (transfer target). The constant voltage source 58 in the present embodiment generates a negative bias voltage. The bias voltage is for example −1600 V.

At the time of the primary transfer, a negative current flows into each of the photosensitive drums 31*y*, 31*c*, 31*m*, and 31*bk* from a corresponding one of the primary transfer rollers 52*y*, 52*c*, 52*m*, and 52*bk* through the intermediate transfer belt 51. That is, a current flows into each of the primary transfer rollers 52*y*, 52*c*, 52*m*, and 52*bk* from a corresponding one of the photosensitive drums 31*y*, 31*c*, 31*m*, and 31*bk*.

The primary transfer rollers 52*y*, 52*c*, 52*m*, and 52*bk* in the present embodiment are each displaced (shifted) downstream of a corresponding one of the photosensitive drums 31*y*, 31*c*, 31*m*, and 31*bk* in the rotational direction X of the intermediate transfer belt 51. The displacement of the primary transfer rollers 52*y*, 52*c*, 52*m*, and 52*bk* results in reduction of the area of each primary transfer nip N1. As a result, as compared with a situation in which the primary transfer rollers are each located right above a corresponding one of the photosensitive drums (i.e., situation in which the central axis of each primary transfer roller is aligned with the central axis of a corresponding photosensitive drum in the rotational direction of the intermediate transfer belt), values of currents flowing into the photosensitive drums 31*y*, 31*c*, 31*m*, and 31*bk* from the respective primary transfer rollers 52*y*, 52*c*, 52*m*, and 52*bk* are reduced even in a configuration in which the single constant voltage source 58 gives a potential to each of the primary transfer rollers 52*y*, 52*c*, 52*m*, and 52*bk*. Further, through the above, the values of the currents flowing into the photosensitive drums 31*y*, 31*c*, 31*m*, and 31*bk* are equalized.

Thus, the values of the currents flowing into the photosensitive drums 31*y*, 31*c*, 31*m* and 31*bk* are reduced and equalized according to the present embodiment in a configuration in which the number of power supply devices (the constant voltage source 58 in the present embodiment) is smaller than the number of the primary transfer rollers 52*y*, 52*c*, 52*m*, and 52*bk*. Therefore, occurrence of the transfer memory and insufficient density are prevented resulting in prevention of deterioration of image quality. Further, the power supply section 57 in the present embodiment includes a power supply device (the constant voltage source 58 in the present embodiment) connected to at least two primary transfer rollers (the primary transfer rollers 52*y*, 52*c*, 52*m*, and 52*bk* in the present embodiment) of the primary transfer rollers 52*y*, 52*c*, 52*m*, and 52*bk*. Therefore, the image forming apparatus 1 is simplified and downsized by setting the number of power supply devices (the constant voltage source in the present embodiment) smaller than the number of the primary transfer rollers.

Further, in a situation in which the primary transfer rollers are each located right above a corresponding one of the photosensitive drums, currents flowing from the primary transfer rollers into the photosensitive drums flow in the direction of thickness of the intermediate transfer belt. Therefore, the currents flowing into the photosensitive drums are influenced by the volume resistivity of the intermediate transfer belt. As a result, values of the currents flowing into the photosensitive drums may vary due to variation of the thickness of the intermediate transfer belt (variation of the volume resistivity). Particularly in a situation in which a thermoplastic resin is used as the material of the elastic layer of the intermediate transfer belt, the values of the currents flowing into the photosensitive drums tend to vary due to large variation of the thickness of the intermediate transfer belt (variation of the volume resistivity).

By contrast, the primary transfer rollers 52*y*, 52*c*, 52*m*, and 52*bk* in the present embodiment are displaced (shifted). Therefore, currents tend to flow along the surface of the intermediate transfer belt 51 into the photosensitive drums 31*y*, 31*c*, 31*m*, and 31*bk*. As a result, values of the currents flowing into the photosensitive drums 31*y*, 31*c*, 31*m*, and 31*bk* are less influenced by the volume resistivity of the intermediate transfer belt 51 having large variation and more influenced by the surface resistivity of the intermediate transfer belt 51 having small variation. Therefore, the values of the currents flowing into the photosensitive drums 31*y*, 31*c*, 31*m*, and 31*bk* are reduced more stably and equalized.

Further, a positive DC charging roller method is employed in the present embodiment as a method for charging the photosensitive drums 31*y*, 31*c*, 31*m*, and 31*bk*. The transfer memory tends to occur in such a configuration. However, the values of the currents flowing into the photosensitive drums 31*y*, 31*c*, 31*m*, and 31*bk* are reduced in the present embodiment due to the displacement (shifting) of the primary transfer rollers 52*y*, 52*c*, 52*m*, and 52*bk*. Therefore, even in a configuration in which the positive DC charging roller method is employed, the values of the currents flowing into the photosensitive drums 31*y*, 31*c*, 31*m*, and 31*bk* are reduced and equalized. Further, the pre-transfer static elimination is performed on the photosensitive drums 31*c*, 31*m*, and 31*bk* in the present embodiment. Through the above, occurrence of the transfer memory is further prevented.

In the present embodiment, the pre-transfer static elimination is performed on the photosensitive drums 31*c*, 31*m*, and 31*bk* other than the photosensitive drum 31*y* that is located the most upstream in the rotational direction X of the intermediate transfer belt 51. In such a configuration, a surface potential of the photosensitive drum 31*y* may become higher than surface potentials of the other photosensitive drums 31*c*, 31*m*, and 31*bk* and a value of a current flowing into the photosensitive drum 31*y* may become larger than values of currents flowing into the other photosensitive drums 31*c*, 31*m*, and 31*bk*. However, the value of the current flowing into the photosensitive drum 31*y* is reduced in the present embodiment due to the displacement (shifting) of the primary transfer roller 52*y*. Therefore, even in the configuration in which the pre-transfer static elimination is performed on the photosensitive drums 31*c*, 31*m*, and 31*bk* other than the photosensitive drum 31*y*, the values of the currents flowing into the photosensitive drums 31*y*, 31*c*, 31*m*and 31*bk* are reduced and equalized.

Further, variation in thickness may arise among the photosensitive layers of the photosensitive drums 31*y*, 31*c*, 31*m*, and 31*bk* due to exchange of the photosensitive drums 31*y*, 31*c*, 31*m*, and 31*bk*. For example, in a situation in which only one of the photosensitive drums 31*y*, 31*c*, 31*m*, and 31*bk* (a photosensitive drum for one color) has not been exchanged, the thickness of the photosensitive layer of the unexchanged photosensitive drum is smaller than the thicknesses of the photosensitive layers of the other photosensitive drums. In such a situation, a value of a current flowing into the unexchanged photosensitive drum may become larger than values of currents flowing into the other photosensitive drums. However, the values of the currents flowing into the photosensitive drums 31*y*, 31*c*, 31*m*, and 31*bk* are reduced in the present embodiment due to the displacement (shifting) of the primary transfer rollers 52*y*, 52*c*, 52*m*, and 52*bk*. Therefore, the values of the currents flowing into the photosensitive drums 31*y*, 31*c*, 31*m*, and 31*bk* are reduced and equalized even when there is variation in thickness among the photosensitive layers of the photosensitive drums 31*y*, 31*c*, 31*m*, and 31*bk*.

The following describes amounts Ly, Lc, Lm, and Lbk of displacement (shifting) of each of the primary transfer rollers 52*y*, 52*c*, 52*m*, and 52*bk* from a corresponding one of the photosensitive drums 31*y*, 31*c*, 31*m*, and 31*bk* (hereinafter, an amount of displacement of each primary transfer roller will be referred to as "a displacement amount") with reference to FIG. 2. In the present embodiment, the pre-transfer static elimination is performed on the photosensitive drums 31*c*, 31*m*, and 31*bk* other than the photosensitive drum 31*y*. In such a configuration, a surface potential of the photosensitive drum 31*y* may become higher than surface potentials of the other photosensitive drums 31*c*, 31*m*, and 31*bk* and a value of a current flowing into the photosensitive drum 31*y* may become larger than values of currents flowing into the other photosensitive drums 31*c*, 31*m*, and 31*bk*. Therefore, a displacement amount Ly (shift amount) of the primary transfer roller 52*y* is preferably set to be larger than displacement amounts Lc, Lm, and Lbk (shift amounts) of the other primary transfer rollers 52*c*, 52*m*, and 52*bk*. By setting the displacement amounts Ly, Lc, Lm, and Lbk as above, the values of the currents flowing into the photosensitive drums 31*y*, 31*c*, 31*m*, and 31*bk* are equalized.

The displacement amounts Ly, Lc, Lm, and Lbk of the primary transfer rollers 52*y*, 52*c*, 52*m*, and 52*bk* are determined based on a relationship between the values of the currents flowing into the photosensitive drums 31*y*, 31*c*, 31*m*, and 31*bk* and a value of the bias voltage (I-V characteristic). That is, the displacement amounts Ly, Lc, Lm, and Lbk are determined such that the values of the currents flowing into the photosensitive drums 31*y*, 31*c*, 31*m*, and 31*bk* are equalized for a value of the bias voltage to be used.

The displacement amounts Ly, Lc, Lm, and Lbk are preferably set according to the following conditions (a) to (f). The values of the currents flowing into the photosensitive drums 31*y*, 31*c*, 31*m*, and 31*bk* are reduced and equalized according to the conditions (a) to (f).

(a) A displacement amount is reduced as the surface resistivity of the intermediate transfer belt becomes larger.

(b) A displacement amount is increased as the diameter of the photosensitive drums becomes larger.

(c) A displacement amount is increased as a surface potential of a photosensitive drum becomes higher.

(d) A displacement amount is reduced as the thickness of the intermediate transfer belt becomes larger.

(e) A displacement amount is reduced as the surface resistivity of the primary transfer rollers becomes larger.

(f) A displacement amount is increased as the diameter of the primary transfer rollers becomes larger.

In the present embodiment, the displacement amounts Ly, Lc, Lm, and Lbk are preferably set to be at least 3.0 mm Through the above, the values of the currents flowing into the photosensitive drums 31*y*, 31*c*, 31*m*, and 31*bk* are reduced and equalized. For example, the displacement amount Ly may be set at 6.0 mm and the displacement amounts Lc, Lm, and Lbk may be set at 4.0 mm. The displacement amount Ly is the displacement amount of the primary transfer roller 52*y* that is located the most upstream among the primary transfer rollers 52*y*, 52*c*, 52*m*, and 52*bk* in the rotational direction X of the intermediate transfer belt 51. The displacement amounts Lc, Lm, and Lbk are the displacement amounts of the primary transfer rollers 52*c*, 52*m*, and 52*bk* that are located downstream of the primary transfer roller 52*y* in the rotational direction X of the intermediate transfer belt 51.

The displacement amounts Lc, Lm, and Lbk of the primary transfer rollers 52*c*, 52*m*, and 52*bk* need not be necessarily the same. When a color image is formed, a thickness of toner images (color toner images) on the intermediate transfer belt 51 typically increases downstream in the rotational direction X of the intermediate transfer belt 51. Therefore, currents flowing into the photosensitive drums 31*c*, 31*m*, and 31*bk* are preferably larger than currents flowing into the adjacent upstream photosensitive drums 31*y*, 31*c*, and 31*m*, respectively. Therefore, the displacement amounts Ly, Lc, Lm, and Lbk of the primary transfer rollers 52*y*, 52*c*, 52*m*, and 52*bk* may be set so as to decrease downstream in the rotational direction X of the intermediate transfer belt 51. Through the above, values of currents flowing into the photosensitive drums 31*y*, 31*c*, 31*m*, and 31*bk* increase downstream in the rotational direction X of the intermediate transfer belt 51.

Through the above, the displacement amounts Ly, Lc, Lm, and Lbk of the primary transfer rollers 52*y*, 52*c*, 52*m*, and 52*bk* have been described. As described above, the displacement amounts Ly, Lc, Lm, and Lbk in the present embodiment preferably satisfy a relationship represented by Formula (1) given below.

$$Ly > Lc \geq Lm \geq Lbk \quad (1)$$

Although the present embodiment has been described for a configuration in which the single constant voltage source 58 applies the bias voltage to the four primary transfer rollers 52*y*, 52*c*, 52*m*, and 52*bk*, the present invention is not limited to this configuration. The present invention is applicable to a configuration in which bias voltages are applied to the primary transfer rollers through constant voltage sources (power supply devices) fewer than the primary transfer rollers. The present invention is for example applicable to an image forming apparatus 1 including two constant voltage sources 58*a* and 58*b* as illustrated in FIG. 4.

Figure 4:
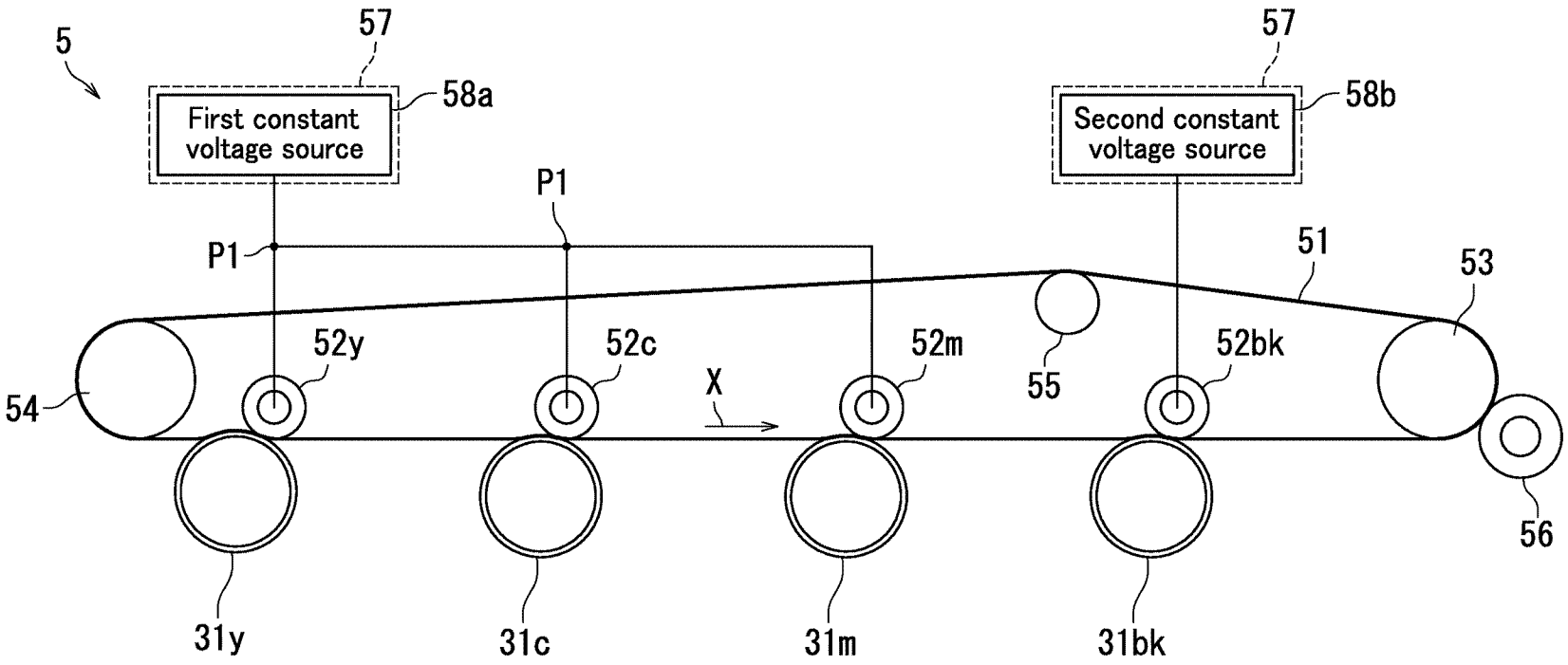
FIG. 4 is a diagram illustrating another example of the power supply system for the primary transfer rollers according to the embodiment of the present invention.

FIG. 4 is a diagram illustrating another example of the power supply system for the four primary transfer rollers 52*y*, 52*c*, 52*m*, and 52*bk*. The transfer section 5 in the example illustrated in FIG. 4 includes a first constant voltage source 58*a* (first power supply device) and a second constant voltage source 58*b* (second power supply device). The first constant voltage source 58*a* is connected to at least two primary transfer rollers (three primary transfer rollers 52*y*, 52*c*, and 52*m* in the example illustrated in FIG. 4) of the four primary transfer rollers 52*y*, 52*c*, 52*m*, and 52*bk* (a plurality of transfer members) and the second constant voltage source 58*b* is connected to the other primary transfer roller (the primary transfer roller 52*bk* in the example illustrated in FIG. 4). That is, the first constant voltage source 58*a* applies a bias voltage to the three primary transfer rollers 52*y*, 52*c*, and 52*m* of the four primary transfer rollers 52*y*, 52*c*, 52*m*, and 52*bk* and the second constant voltage source 58*b* applies a bias voltage to the one primary transfer roller 52*bk*.

The four primary transfer rollers 52*y*, 52*c*, 52*m*, and 52*bk* are all displaced in the example illustrated in FIG. 4. Therefore, effects similar to those achieved by the image forming apparatus 1 described above with reference to FIGS. 1 to 3 can be achieved by adjusting the displacement amounts Ly, Lc, Lm, and Lbk of the primary transfer rollers 52*y*, 52*c*, 52*m*, and 52*bk* as in the image forming apparatus 1 described above with reference to FIGS. 1 to 3.

Further, in the example illustrated in FIG. 4, the second constant voltage source 58*b* applies the bias voltage to the primary transfer roller 52*bk* that is located the most downstream among the four primary transfer rollers 52*y*, 52*c*, 52*m*, and 52*bk* in the rotational direction X of the intermediate transfer belt 51. Therefore, a toner image in black can be formed without applying the bias voltage to the primary transfer rollers 52*y*, 52*c*, and 52*m* other than the primary transfer roller 52*bk* through the first constant voltage source 58*a*. Accordingly, power consumption at the time of formation of the toner image in black only can be reduced.

Further, in the example illustrated in FIG. 4, the bias voltage is applied to the primary transfer roller 52*bk* through a power supply device (the second constant voltage source 58*b*) different from that applies the bias voltage to the other three primary transfer rollers 52*y*, 52*c*, and 52*m*. Therefore, a value of a current flowing into the photosensitive drum 31*bk* corresponding to the primary transfer roller 52*bk* is controllable through the second constant voltage source 58*b*. Accordingly, the primary transfer roller 52*bk* may be located right above the photosensitive drum 31*bk* without displacement (shifting). Alternatively, the primary transfer roller 52*bk* may be displaced to control the value of the current flowing into the photosensitive drum 31*bk* through the displacement amount Lbk of the primary transfer roller 52*bk* and the second constant voltage source 58*b*.

In the image forming apparatus 1 described above with reference to FIGS. 1 to 3, the pre-transfer static elimination is performed on the photosensitive drums 31*c*, 31*m*, and 31*bk* other than the photosensitive drum 31*y* that is located the most upstream in the rotational direction X of the intermediate transfer belt 51. Meanwhile, in the configuration illustrated in FIG. 4, the first constant voltage source 58*a* applies the bias voltage to the three primary transfer rollers 52*y*, 52*c*, and 52*m*. The three primary transfer rollers 52*y*, 52*c*, and 52*m* include the primary transfer roller 52*y* corresponding to the photosensitive drum 31*y* to which the pre-transfer static elimination is not performed. Therefore, in the configuration illustrated in FIG. 4, the displacement amounts Ly, Lc, and Lm of the primary transfer rollers 52*y*, 52*c*, and 52*m* preferably satisfy a relationship represented by Formula (2) given below as in the image forming apparatus 1 described above with reference to FIGS. 1 to 3.

$$Ly > Lc \geq Lm \tag{2}$$

Through the above, the embodiment of the present invention has been described with reference to the drawings. It should be noted that the present invention is not limited to the above embodiment and is practicable in various manners within the scope not departing from the gist of the present invention.

For example, in the above-described embodiment of the present invention, the photosensitive drums 31 are each charged to a positive potential. However, the present invention is not limited to such a configuration. The photosensitive drums 31 may each be charged to a negative potential. In this case, the primary transfer rollers 52 are each charged to a positive potential.

In the above-described embodiment of the present invention, the photosensitive drums 31 are charged by a roller method. However, the present invention is not limited to such a configuration. For example, the photosensitive drums 31 may be charged by a belt method.

In the above-described embodiment of the present invention, the photosensitive drums 31 are each charged by a direct current voltage. However, the present invention is not limited to such a configuration. The photosensitive drums 31 may each be charged by a voltage obtained by superimposing an alternating current voltage on a direct current voltage.

In the above-described embodiment of the present invention, the photosensitive drums 31 are charged by proximity discharge. However, the present invention is not limited to such a configuration. For example, the photosensitive drums 31 may be charged by a scorotron method.

In the above-described embodiment of the present invention, the photosensitive drums 31 each include a positively chargeable single-layer organic photosensitive member. However, the present invention is not limited to such a configuration. The photosensitive drums 31 may each include a negatively chargeable organic photosensitive member. Alternatively, the photosensitive drums 31 may each include an inorganic photosensitive member. Also, the photosensitive layers of the photosensitive drums 31 may each have a multi-layer structure.

In the above-described embodiment of the present invention, the central axis of each of the primary transfer rollers 52 is shifted (displaced) downstream of the central axis of a corresponding one of the photosensitive drums 31 in the rotational direction X (moving direction) of the intermediate transfer belt 51. However, the primary transfer rollers 52 may each be displaced upstream. Also, it is not required that all the primary transfer rollers 52 are displaced in the same direction. That is, there may be both a primary transfer roller 52 that is shifted downstream of the central axis of a corresponding one of the photosensitive drums 31 and another primary transfer roller 52 that is shifted upstream of the central axis of a corresponding one of the photosensitive drums 31 in the rotational direction X of the intermediate transfer belt 51.

In the above-described embodiment of the present invention, the single constant voltage source 58 or the two constant voltage sources 58*a* and 58*b* is/are used as the power supply device(s) for charging the four primary transfer rollers 52. However, the present invention is not limited to such a configuration. No specific limitations are placed on the number of the constant voltage sources (power supply devices) as long as the number is fewer than the number of the primary transfer rollers.

In the above-described embodiment of the present invention, the image forming apparatus 1 includes the first constant voltage source 58*a* connected to the three primary transfer rollers 52 and the second constant voltage source 58*b* connected to the one primary transfer roller 52. However, the present invention is not limited to such a configuration. For example, two constant voltage sources (power supply devices) may each be connected to a plurality of primary transfer rollers. Also, in a configuration in which a plurality of constant voltage sources (power supply devices) are used, no specific limitations are placed on connection destinations of the respective constant voltage sources (power supply devices).

In the above-described embodiment of the present invention, the constant voltage sources (constant voltage sources 58, 58*a*, and 58*b*) are used as the power supply devices for charging the four primary transfer rollers 52. However, the present invention is not limited to such a configuration. The power supply sources may be constant current sources.

Various alterations other than those described above may be made within the scope not departing from the gist of the present invention.

EXAMPLES

The following describes examples of the present invention. However, the present invention is not limited to the following examples.

Examples 1 to 3 and Comparative Examples 1 and 2

In the first through third examples and the first and second comparative examples, positively chargeable single-layer organic photosensitive drums having a diameter ϕ of 30 mm, primary transfer rollers having a diameter ϕ of 12.0 mm, and an intermediate transfer belt having a thickness of 120 μm were used. Carbon was dispersed in an elastic material of the primary transfer rollers to impart a conductive property to the elastic material of the primary transfer rollers. Similarly, carbon was dispersed in the intermediate transfer belt to impart a conductive property to the intermediate transfer belt. Photosensitive layers of the photosensitive drums had a thickness of 15 μm. The photosensitive drums were charged by the positive DC charging roller method such that the photosensitive drums had a surface potential of 500 V. The primary transfer rollers had a surface resistivity of $1.0\times10^{7}$ Ω/sq at the time of application of a voltage of 1000 V. The intermediate transfer belt had a surface resistivity of $1.0\times10^{10}$ Ω/sq at the time of application of a voltage of 250 V. Under the above conditions, a bias voltage was applied to the primary transfer rollers and values of currents flowing into the photosensitive drums were measured. The values of the currents flowing into the photosensitive drums were measured at points of connection between a constant voltage source and the primary transfer rollers.

Figure 5:
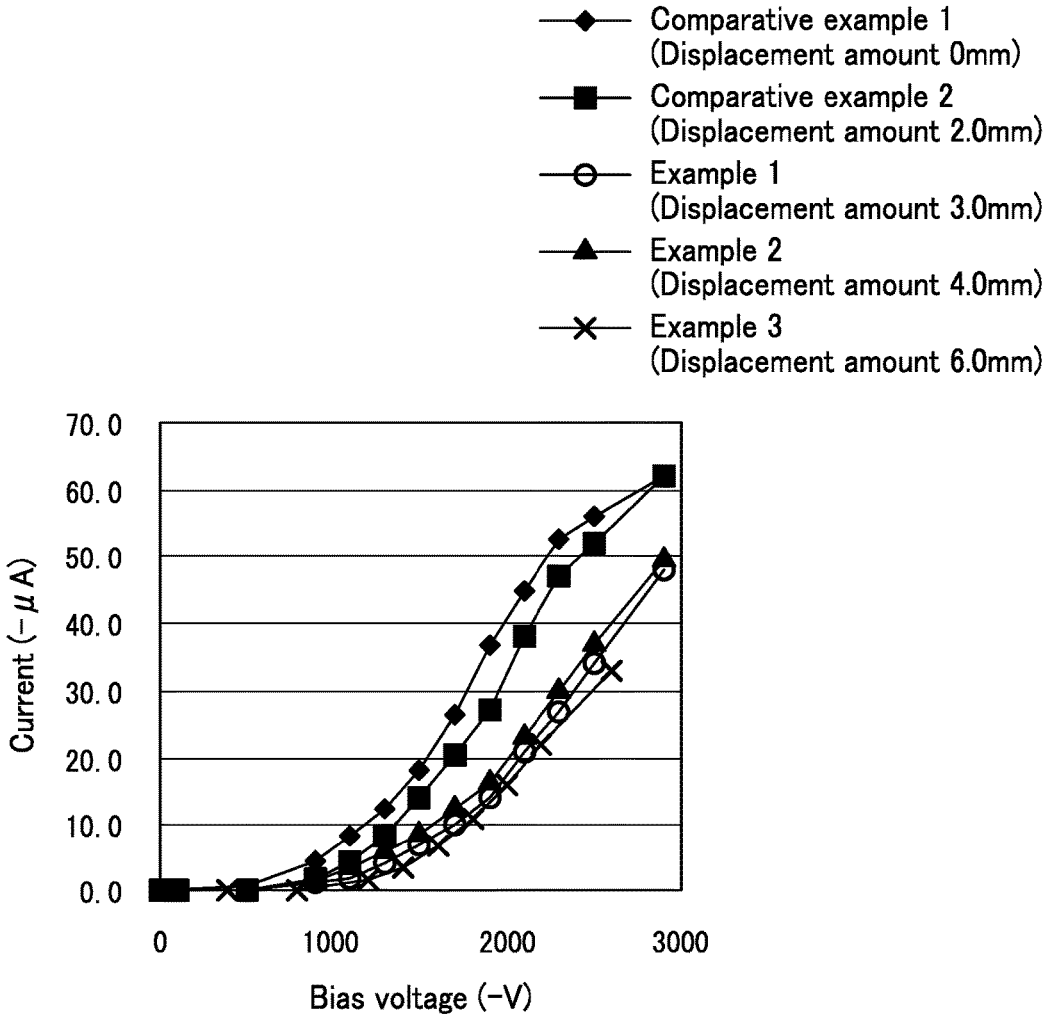
FIG. 5 shows results of first through third examples of the present invention and first and second comparative examples.

In the first example, a value of a current flowing into the photosensitive drum was measured by setting a displacement amount of the primary transfer roller at 3.0 mm That is, the value of the current flowing into the photosensitive drum was measured by shifting the position of the primary transfer roller by 3.0 mm with respect to the photosensitive drum. In the second example, a value of a current flowing into the photosensitive drum was measured by setting a displacement amount of the primary transfer roller at 4.0 mm That is, the value of the current flowing into the photosensitive drum was measured by shifting the position of the primary transfer roller by 4.0 mm with respect to the photosensitive drum. In the third example, a value of a current flowing into the photosensitive drum was measured by setting a displacement amount of the primary transfer roller at 6.0 mm That is, the value of the current flowing into the photosensitive drum was measured by shifting the position of the primary transfer roller by 6.0 mm with respect to the photosensitive drum. In the first comparative example, a value of a current flowing into the photosensitive drum was measured without displacing (shifting) the primary transfer roller. That is, the value of the current flowing into the photosensitive drum was measured by setting a displacement amount of the primary transfer roller at 0.0 mm. In the second comparative example, a value of a current flowing into the photosensitive drum was measured by setting a displacement amount of the primary transfer roller at 2.0 mm That is, the value of the current flowing into the photosensitive drum was measured by shifting the position of the primary transfer roller by 2.0 mm with respect to the photosensitive drum. FIG. 5 shows measurement results of the first through third examples and the first and second comparative examples.

FIG. 5 shows graphs (I-V characteristics) obtained by plotting values of currents (-μA) flowing into the photosensitive drums with respect to values of the bias voltage (-V). In FIG. 5, the vertical axis represents the values of the currents (-μA) flowing into the photosensitive drums and the horizontal axis represents the values of the bias voltage (-V).

As shown in FIG. 5, around a value of "−1600 V" of the bias voltage that is necessary for the primary transfer, values of the currents decreased in situations in which the displacement amounts of the primary transfer rollers were at least 3.0 mm It was found from the results in FIG. 5 that in a situation in which displacement amounts of the primary transfer rollers 52*y*, 52*c*, 52*m*, and 52*bk* are set at "6.0 mm", "4.0 mm", "4.0 mm", and "4.0 mm", respectively, currents of "7.0 μA", "8.0 μA", "8.0 μA", and "8.0 μA" flow into the photosensitive drums 31*y*, 31*c*, 31*m*, and 31*bk*, respectively, around the value of "−1600 V" of the bias voltage that is necessary for the primary transfer.

Example 4 and Comparative Example 3

Figure 6:
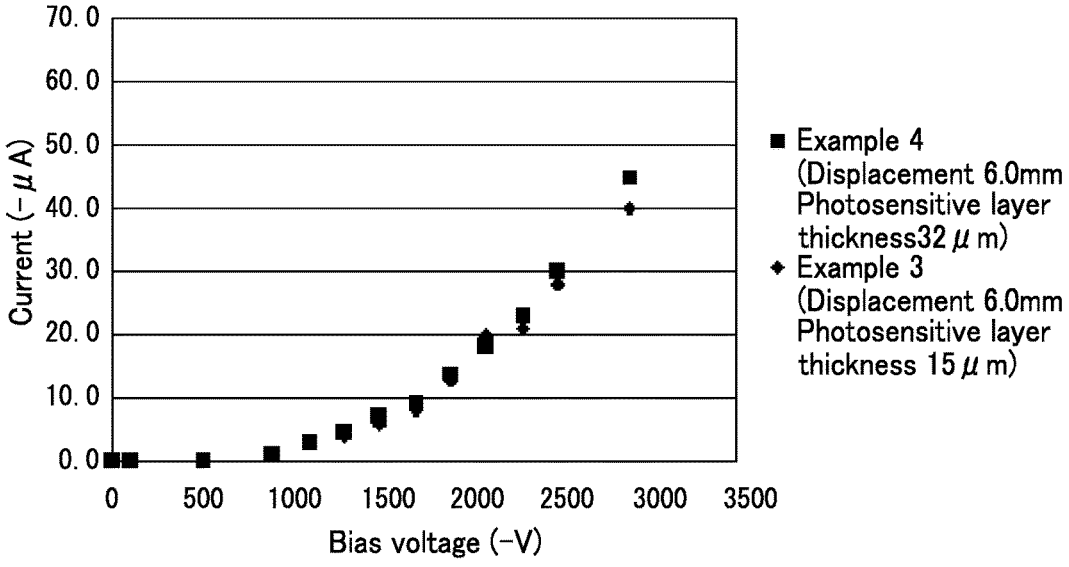
FIG. 6 shows results of the third and fourth examples of the present invention.
Figure 7:
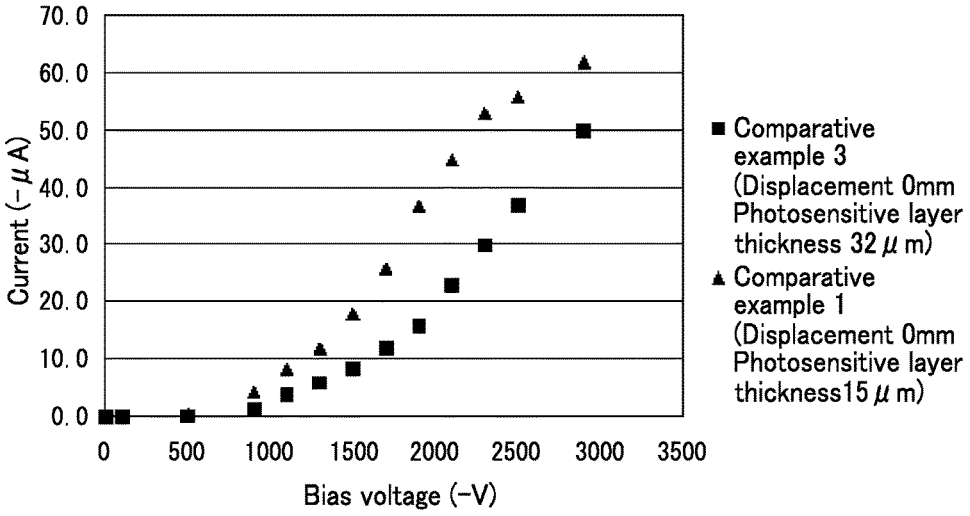
FIG. 7 shows results of the first and third comparative examples.

In the fourth example and the third comparative example, photosensitive layers of photosensitive drums had a thickness of 32 μm. Values of currents flowing into the photosensitive drums were measured under the same conditions as the third example and the first comparative example other than the thickness of the photosensitive layers of the photosensitive drums. That is, in the fourth example, a value of a current flowing into the photosensitive drum was measured by setting a displacement amount of the primary transfer roller at 6.0 mm, as in the third example. In the third comparative example, a value of a current flowing into the photosensitive drum was measured without displacing (shifting) the primary transfer roller, as in the first comparative example. FIG. 6 shows measurement results of the fourth example together with the measurement results of the third example. FIG. 7 shows measurement results of the third comparative example together with the measurement results of the first comparative example.

FIGS. 6 and 7 show graphs (I-V characteristics) obtained by plotting values of currents (-μA) flowing into the photosensitive drums with respect to values of the bias voltage (-V).

In FIGS. 6 and 7, the vertical axis represents the values of the currents (-μA) flowing into the photosensitive drums and the horizontal axis represents the values of the bias voltage (-V). As shown in FIG. 7, in situations in which the primary transfer rollers were not displaced, values of currents flowing into the photosensitive drums had large variation due to variation in the thickness of the photosensitive layers included in the photosensitive drums. By contrast, as shown in FIG. 6, in situations in which the primary transfer rollers were displaced, values of currents flowing into the photosensitive drums had no variation due to variation in the thickness of the photosensitive layers included in the photosensitive drums around the value of "−1600 V" of the bias voltage that is necessary for the primary transfer. Although the values of the currents varied when an absolute value of the bias voltage was greater than "2250 V", the variation was small. Through the above, it was found that values of currents flowing into the photosensitive drums 31*y*, 31*c*, 31*m*, and 31*bk* are equalized by displacing the primary transfer rollers 52*y*, 52*c*, 52*m*, and 52*bk* even when there is variation in thickness among the photosensitive layers of the photosensitive drums 31*y*, 31*c*, 31*m*, and 31*bk*.

INDUSTRIAL APPLICABILITY

The present invention can be suitably applicable to image forming apparatuses such as a copier, a printer, a facsimile machine, and a multifunction peripheral.

The invention claimed is:

1. An image forming apparatus capable of forming a color image by transferring toner images in respective colors different from one another such that the toner images are superimposed on one another, the image forming apparatus comprising:

a plurality of image bearing members each capable of bearing one of the toner images in the respective colors;

a plurality of transfer members each located opposite to a corresponding one of the plurality of image bearing members; and a power supply section capable of causing the toner images on the respective image bearing members to be transferred to a moving transfer target by charging the plurality of transfer members, wherein the power supply section includes a first power supply device connected to at least two transfer members of the plurality of transfer members, and the at least two transfer members of the plurality of transfer members connected to the first power supply device are each located at a position shifted upstream or downstream of a corresponding one of the image bearing members in a moving direction of the moving transfer target.

2. The image forming apparatus according to claim 1, further comprising a plurality of static eliminating devices each configured to eliminate static electricity from a corresponding one of the plurality of image bearing members, wherein a static eliminating device of the plurality of static eliminating devices that is located between adjacent image bearing members of the plurality of image bearing members irradiates with light respective image bearing members of the plurality of image bearing members located upstream and downstream in the moving direction of the moving transfer target.

3. The image forming apparatus according to claim 2, wherein the first power supply device is connected to at least two transfer members of the plurality of transfer members, the at least two transfer members including a transfer member located the most upstream among the plurality of transfer members in the moving direction of the moving transfer target.

4. The image forming apparatus according to claim 3, wherein the transfer member located the most upstream in the moving direction of the moving transfer target is shifted by a shift amount larger than shift amounts of the other transfer members.

5. The image forming apparatus according to claim 4, wherein the shift amounts of the other transfer members are the same.

6. The image forming apparatus according to claim 4, wherein the transfer members are shifted by shift amounts that decrease downstream in the moving direction of the moving transfer target.

7. The image forming apparatus according to claim 1, wherein the plurality of image bearing members each include a positively chargeable photosensitive member, and the image forming apparatus further includes a plurality of chargers each capable of charging a corresponding one of the photosensitive members to a positive potential.

8. The image forming apparatus according to claim 1, wherein the first power supply device is connected to all the plurality of transfer members.

9. The image forming apparatus according to claim 1, wherein the power supply section further includes a second power supply device connected to one transfer member of the plurality of transfer members.

10. The image forming apparatus according to claim 9, wherein the one transfer member connected to the second power supply device is located at a position shifted upstream or downstream of a corresponding one of the image bearing members in the moving direction of the moving transfer target.

11. The image forming apparatus according to claim 9, wherein the one transfer member connected to the second power supply device is located at the same position as a corresponding one of the image bearing members in the moving direction of the moving transfer target.

12. The image forming apparatus according to claim 9, wherein the second power supply device is connected to a transfer member of the plurality of transfer members that is located opposite to an image bearing member of the plurality of image bearing members that bears a toner image in black color.

13. The image forming apparatus according to claim 4, wherein the transfer members are each shifted by a shift amount of at least 3.0 mm.

14. The image forming apparatus according to claim 13, wherein the transfer member located the most upstream in the moving direction of the moving transfer target is shifted by a shift amount of at least 6.0 mm.

* * * * *